US005970756A

United States Patent [19]

Miller et al.

[11] Patent Number: 5,970,756

[45] Date of Patent: Oct. 26, 1999

[54] DEAD BOLT LOCK ASSEMBLY COVER

[75] Inventors: Edward Miller, Falls Church; Russell Waller, Dumfries, both of Va.; J. Clayton Miller, Nicholasville, Ky.

[73] Assignee: Federal Security Systems, Inc., Newington, Va.

[21] Appl. No.: 08/826,584

[22] Filed: Apr. 3, 1997

[51] Int. Cl.[6] ..... E05B 15/16

[52] U.S. Cl. ..... 70/168; 70/172; 70/232; 70/333 A; 70/416; 70/417; 70/DIG. 57

[58] Field of Search ..... 70/416, 417, 418, 70/DIG. 58, 1.5, 209, 232, 423–428, 455, DIG. 57, 158, 163–173, DIG. 56, 333 R, 333 A

[56] References Cited

U.S. PATENT DOCUMENTS

| | | | |
|---|---|---|---|
| 1,166,231 | 12/1915 | Lewis | 70/DIG. 58 X |
| 1,687,388 | 10/1928 | Rigo | 70/418 |
| 2,020,879 | 11/1935 | Eldred | 70/333 A |
| 2,716,882 | 9/1955 | Gill et al. | 70/DIG. 58 X |
| 3,666,309 | 5/1972 | Zarzycki | 292/337 |
| 3,685,036 | 8/1972 | Torok | 70/431 X |
| 3,699,788 | 10/1972 | Gerlach et al. | 70/134 |
| 3,731,506 | 5/1973 | Geene | 70/97 |
| 3,768,284 | 10/1973 | Kent et al. | 70/418 X |
| 3,769,822 | 11/1973 | Yulkowski | 70/107 |
| 3,774,420 | 11/1973 | Orr | 70/104 |
| 3,934,437 | 1/1976 | Crepinsek | 70/370 |
| 3,976,318 | 8/1976 | Krus | 70/418 X |
| 4,044,579 | 8/1977 | Le Bel | 70/416 |
| 4,227,386 | 10/1980 | Crockett | 70/118 |
| 4,232,353 | 11/1980 | Mosciatti et al. | 70/277 X |
| 4,283,881 | 8/1981 | Moore et al. | 49/35 |
| 4,350,032 | 9/1982 | Kochackis | 70/427 |
| 4,353,582 | 10/1982 | Eigemeier | 292/169.15 |
| 4,372,590 | 2/1983 | Pilat et al. | 292/33 |
| 4,398,470 | 8/1983 | Williams et al. | 109/52 |
| 4,418,552 | 12/1983 | Nolin | 70/107 |
| 4,422,313 | 12/1983 | VanderWyde | 70/167 |
| 4,466,264 | 8/1984 | del Nero | 70/417 |
| 4,502,609 | 3/1985 | Christatos | 220/329 |
| 4,503,692 | 3/1985 | Grint | 70/418 |
| 4,548,062 | 10/1985 | Kaufman | 70/417 |
| 4,669,282 | 6/1987 | Hoyt et al. | 70/129 |
| 4,696,174 | 9/1987 | Marks | 70/451 |
| 4,748,833 | 6/1988 | Nagasawa | 70/214 |
| 4,763,499 | 8/1988 | Boyle | 70/417 |
| 4,807,455 | 2/1989 | Mauer | 70/277 |
| 4,885,921 | 12/1989 | Sharav | 70/159 |
| 5,014,527 | 5/1991 | Traller et al. | 70/94 |
| 5,199,288 | 4/1993 | Meriläinen et al. | 70/279 |
| 5,201,202 | 4/1993 | Kam | 70/168 |
| 5,257,519 | 11/1993 | Miller, III | 70/303 A |
| 5,284,038 | 2/1994 | Johnson | 70/232 |
| 5,388,435 | 2/1995 | Bailey | 70/101 |
| 5,450,662 | 9/1995 | Watts | 70/494 X |
| 5,528,915 | 6/1996 | Percoco | 70/416 |
| 5,531,086 | 7/1996 | Bryant | 70/279 |
| 5,544,509 | 8/1996 | Mielonen | 70/366 |

FOREIGN PATENT DOCUMENTS

| | | | |
|---|---|---|---|
| 143700 | 10/1951 | Australia | 70/416 |
| 928473 | 11/1947 | France | 70/416 |
| 65913 | 3/1943 | Norway | 70/416 |
| 5130 | of 1914 | United Kingdom | 70/416 |
| 322103 | 11/1929 | United Kingdom | 70/416 |
| 329250 | 5/1930 | United Kingdom | 70/416 |
| 351049 | 6/1931 | United Kingdom | 70/416 |
| 435274 | 9/1935 | United Kingdom | 70/416 |
| 594693 | 11/1947 | United Kingdom | 70/416 |
| 619653 | 3/1949 | United Kingdom | 70/416 |
| 679569 | 9/1952 | United Kingdom | 70/416 |
| 783438 | 9/1957 | United Kingdom | 70/161 |
| 2174748 | 11/1986 | United Kingdom | 70/416 |

*Primary Examiner*—Lloyd A. Gall
*Attorney, Agent, or Firm*—Dickson Wright PLLC

[57] ABSTRACT

A dead bolt lock cover for a dead bolt lock assembly comprises a cover and a lock assembly. The cover is sized to enclose the lock casing of the dead bolt lock assembly to prevent unauthorized tampering therewith. The lock assembly fixes the cover to the dead bolt lock base or a separate base member. With the lock assembly, only an authorized person can gain access to the lock casing of the dead bolt lock.

17 Claims, 3 Drawing Sheets

DEAD BOLT LOCK ASSEMBLY COVER

TECHNICAL FIELD

The present invention is directed to a cover for a dead bolt lock assembly and, in particular, to a cover designed to prevent unauthorized access to the lock cover of a lock casing of the dead bolt lock assembly.

BACKGROUND ART

In the lock industry, the use of dead bolts for security purposes are well known. U.S. Pat. No. 5,257,519 to Miller, discloses a dead bolt lock assembly for use with a combination dial lock assembly. The dead bolt lock assembly includes a housing structure adapted to receive a combination dial lock assembly. The housing structure includes a bolt holdback assembly which prevents extension of a dead bolt into a door strike. The bolt holdback assembly is operable from the inside of the door preventing manipulation of the combination dial on the outside of the door. Arranging the bolt holdback assembly in the housing permits the use of replacement and/or repair of standard or off the shelf type combination locks with the dead bolt assembly.

The Miller dead bolt lock assembly is shown in FIG. 1 and designated by the reference numeral 10. The dead bolt lock assembly includes a base 1 which has as part thereof the dead bolt lock 6. A lock casing 3 of a lock (not shown) is shown supported by the base 1 and positioned between the side walls 5. The dead bolt lock assembly includes a strike 7, a dead bolt operating knob 9 and the bolt holdback knob 11. The lock casing 3 has a lock cover 13 which is removable to gain entry to the lock components of the lock within the lock casing 3.

FIG. 2 shows another prior art dead bolt lock assembly which is manufactured by the Mas-Hamilton group of Lexington, Ky. This dead bolt lock assembly is identical to the lock shown in FIG. 1 in terms of the bolt holdback feature described above. The dead bolt lock assembly of FIG. 2 functions in the same way to obtain the same result as that shown in FIG. 1, i.e., hold the dead bolt back by operation of the knob 11, see FIG. 1 or the dead bolt holdback knob 11' in FIG. 2 (the only difference being the base configuration which does not alter the lock functions). The dead bolt lock assembly 20 of FIG. 2 also includes a base 1' supporting a lock casing 3, the lock casing 3 having the lock cover 13 attached thereto. The dead bolt lock assembly 20 also includes a strike 7 and a dead bolt operating knob 9. The base 1' of the dead bolt lock assembly 20 includes openings 15 which receive fasteners (not shown) to attach the base 1' to a surface. The openings 15 are similar to the FIG. 1 dead bolt lock assembly openings 17 in the sidewalls thereof.

One problem with these types of dead bolt locks is the vulnerability of the access cover 13 to unauthorized removable. Since the access cover 13 is usually secured to the lock casing 3 by screws, the access cover can be removed in a short period of time. The lock within the lock casing can then be altered to permit unauthorized operation of the lock and compromise any secured area that the lock is intended to protect.

Even if other persons may be in the secured area, an individual could quickly remove the lock cover 13 and alter the lock while the other persons are distracted or not paying attention. With an altered lock an unauthorized person could gain access to the secured area at a later time.

In view of the security problem that exposed lock covers present, a need has developed to prevent or protect unauthorized access to the lock components of the lock casing. The present invention solves this need by providing a dead bolt lock access cover which is designed to be removed by an authorized person.

DISCLOSURE OF THE INVENTION

Accordingly, a first object of the present invention is to provide an improved dead bolt lock access cover.

Another object of the present invention is a dead bolt access cover which is locked onto a dead bolt lock assembly and can only be removed by unlocking the access cover lock with a key or other equivalent.

A further object of the invention is using the dead bolt lock access cover to prevent access to the lock components of a lock casing but also prevent access to any fasteners which attach the dead bolt lock assembly to a given surface.

Other objects and advantages of the present invention will become apparent as a description thereof proceeds.

In satisfaction of the foregoing objects and advantages, the present invention is an improvement over existing dead bolt lock assemblies which have a dead bolt lock and a base for attachment to a given surface. It should be understood that the term "base" is intended to encompass the structural aspects of the dead bolt lock assembly which may either facilitate its attachment to a given surface, house operative components of the dead bolt lock or a mounting surface.

According to the invention, the dead bolt lock access cover comprises a cover sized to enclose at least the lock cover and/or casing of the dead bolt lock assembly. In conjunction with the access cover, a lock assembly is provided to removably lock the access cover to the dead bolt lock assembly to prevent unauthorized access to the cover of the lock casing.

In one embodiment, the access cover assembly includes a base member which is removably attached to the dead bolt base or its mounting surface. The access cover assembly also includes a lock linked between the access cover and the base member, opening of the lock permitting removal of the access cover. In one embodiment, the lock is a key lock.

The base member can have opposing sidewalls with a slot in each sidewall. The access cover has opposing edges, each edge sized to slide in a respective slot for attachment of the access cover to the base member. In an alternative embodiment, the base of the dead bolt lock assembly can be slotted to receive the opposing edges of the access cover. In yet a further embodiment, the access cover can be hinged to the base member or base for covering the lock cover of the lock casing. Any lock and lock components can be used to secure the cover to one of the dead bolt lock base, an interface base member and a mounting surface for the dead bolt lock.

BRIEF DESCRIPTION OF DRAWINGS

Reference is now made to the drawings of the invention wherein.

DESCRIPTION OF THE PREFERRED EMBODIMENT

The present invention offers significant advantages over existing dead bolt lock assemblies in terms of improved security. By means of the invention, existing dead bolt lock access assembly can be retro-fitted, modified or used as is with the invention to provide improved security. With the inventive dead bolt access cover, unauthorized access to the lock cover of a lock casing thereof is prevented or made to be more difficult.

Figure 2:
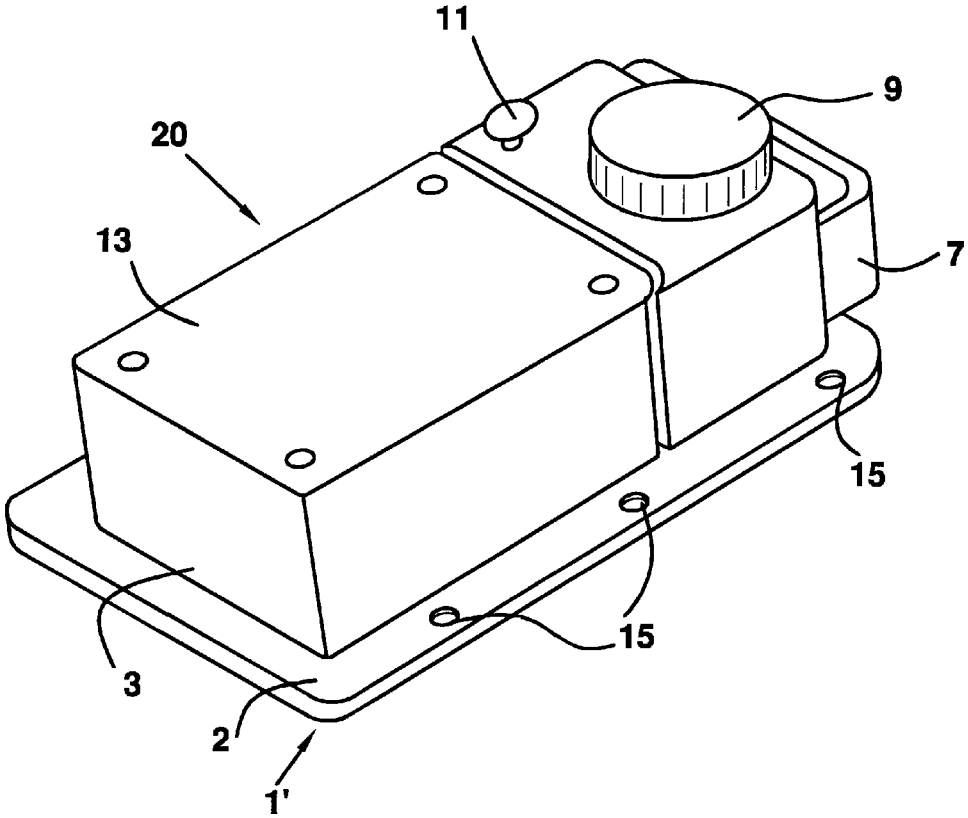
FIG. 2 PRIOR ART
FIG. 2 is a perspective view of another type of prior art dead bolt lock.
Figure 3:
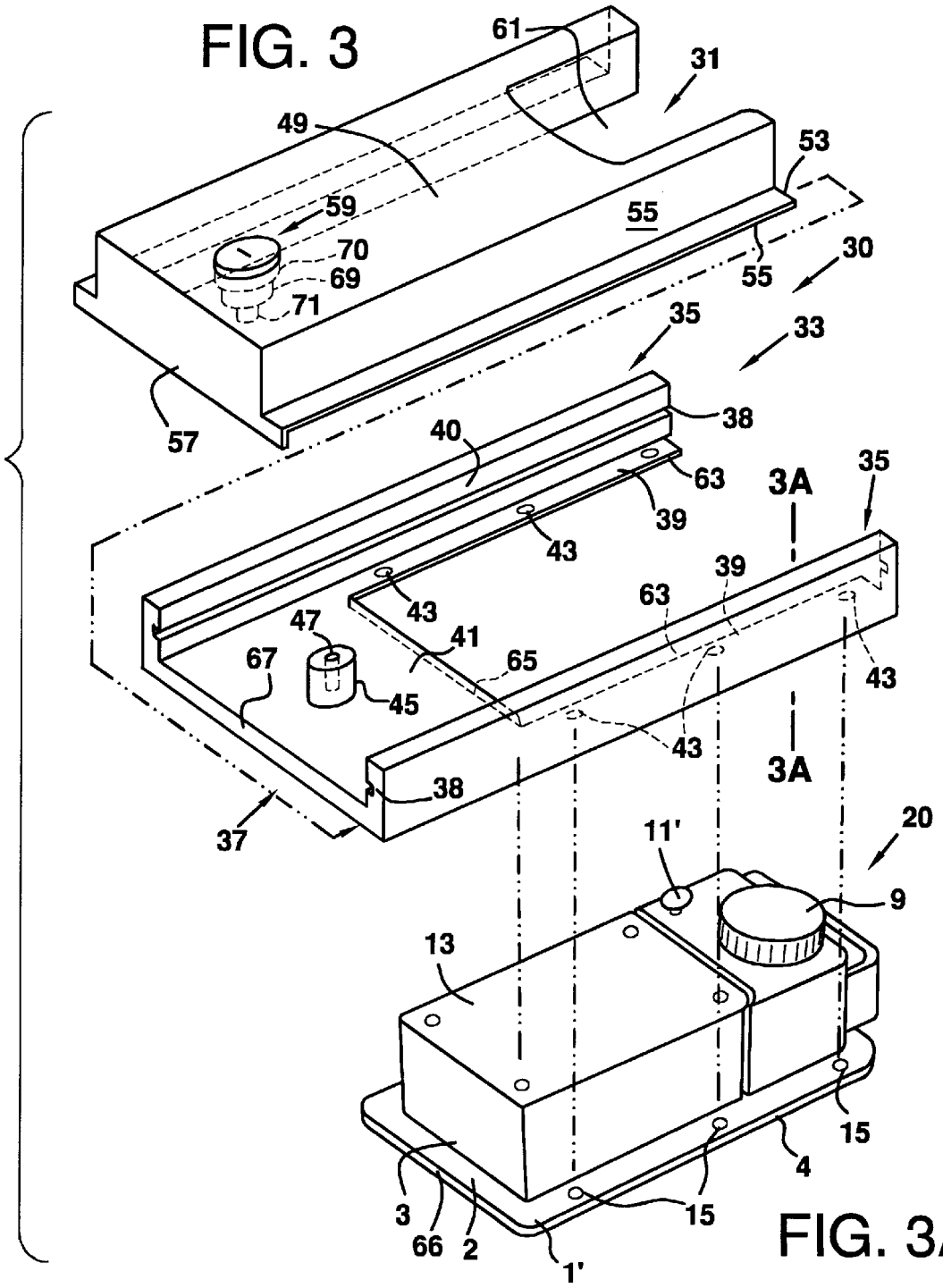
FIG. 3 is a perspective view of one embodiment of the invention shown in exploded view.

Referring now to FIG. 3, one embodiment of the inventive dead bolt lock cover is generally designated by the reference numeral 30 and is used with the dead bolt lock assembly 20 depicted in FIG. 2. The dead bolt lock cover includes the cover 31 and a base member 33.

The base member 33 has a pair of sidewalls 35, the sidewalls separated by a plate 37. Each of the sidewalls 35 has a slot 38 running along the opposing faces 40 of the sidewalls 35. As will be described below, the slots 38 interact with the access cover 31 to prevent access to the access cover 13 of the lock casing 3.

The plate 37 has two portions. A first portion comprises the flanges 39 which extend outwardly from the second or main plate portion 41 and also inwardly from the sidewalls 35. The flanges 39 include a plurality of through holes 43 which are positioned on the flanges 39 to align with the openings 15 in the base 1' of the dead bolt lock 20. This alignment facilitates attachment of the plate 37 to the dead bolt lock assembly 20 as described below.

The main plate portion 41 includes a lock interface 45, shown with a cylindrical shape, and including a threaded bore 47 therein. The lock interface 45 receives a lock associated with the access cover as described below.

The flanges 39 and main plate portion 41 are illustrated with differing thicknesses. The thickness of the main plate portion 41 equals the flange 39 thickness plus the thickness of the flange portion 2 of the base 1' of the dead bolt lock assembly 20. In this way, the main plate portion 41 rests on the same surface as the dead bolt lock assembly . The flanges 39 are then positioned adjacent to the flange portion 2 of the base 1' in the vicinity of the openings 15 so that the throughholes 43 align with the openings 15. Of course other configurations can be used to join the base member 33 to the dead bolt lock.

The access cover 31 includes a top 49, sidewalls 51 and flanges 53 with flange edges 55. One end of the cover 31 has a back plate 57 and the lock 59. The other end of the cover 31 and mass includes the cut out 61 which is sized to permit access to the dead bolt operating knob 9 and the hold back knob 11'. Alternatively, the cover 31 could be sized without the cut out while enclosing the lock cover and permitting dead bolt lock operation.

In the embodiment depicted in FIG. 3, the inventive dead bolt lock access cover can be used with the dead bolt lock assembly 20 either during its initial installation or after the dead bolt lock assembly has been already installed. This feature makes the inventive dead bolt lock access cover adaptable for existing dead bolt lock assemblies.

In one mode of use, the fasteners securing the dead bolt lock 20 to its surface are removed. Second, the base member 33 is positioned atop the flange portion 2 of the dead bolt lock assembly 20. The main plate portion 41 rests on the surface and its end face 65 abuts face 66 of the flange portion 2. The faces 63 of the flanges would then face the sides of the lock casing 3 and dead bolt. In this configuration, the flanges 39 rest on the flange portions 2 so that the fasteners used to secure the dead bolt lock assembly 20 to a surface can then be inserted through the through holes 43 in the flanges 39 and the openings 15 in the flange portion 2 to secure the base member 33 and the dead bolt lock assembly 20 back to the surface.

With the base member 33 installed, the cover 31 is installed by aligning the flange edges 55 with the opposing slots 38 for sliding engagement. The access cover 31 is then slid over the cover 13 and the back plate 57 abuts against the end face 67 of the main plate portion 41. Although not shown, the back plate 57 could have a flange extending inwardly toward the cut out 61. The back end 67 could have a correspondingly sized slot to receive the flange. With this arrangement, it is more difficult to pry open the back plate 57 to attempt to gain access to the lock 59.

Figure 3A:
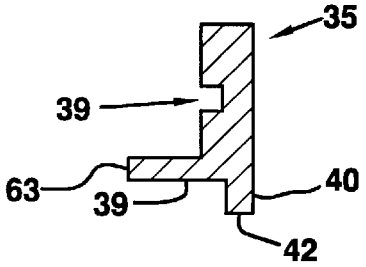
FIG. 3A is a sectional view along the line 3A—3A of FIG. 3.

As an additional optional security measure, see FIGS. 3 and 3A, the sidewalls 35 have a lip 40 which is sized to extend around the edge 4 of the flange portion 2 of the dead bolt lock assembly 20. Face 42 of the lip 40 then abuts the surface to which the dead bolt lock assembly 20 is attached. The lip 40 makes it more difficult to attempt to pry the base member 33 off the flange portion 2. Of course, the lip can be optional.

The lock 59, in one embodiment, is a conventional cam lock plug assembly made by Medeco Security Locks of Salem, Va. These cam lock plug assemblies include a lock cylinder 69 and a threaded bolt 71 extending therefrom with a lock housing 70 secured to the top 49. The threaded bolt 71 is sized to threadably attach to the threaded opening 47 in the lock support 45. It should be understood that the lock cylinder 69 is threadably secured to the lock support 45 after cover insertion. The lock cylinder 69 is inserted through a cut out (not shown) in the top 49 and secured by the appropriate rotation. The key rotation causes a side bar (not shown) of the lock cylinder 69 to engage a groove (not shown) in the lock housing 70. Thus, the lock cylinder cannot be turned and is locked in place. Opening is achieved by key rotation to disengage the side bar from the groove for unthreading of the lock cylinder, lock removal and cover removal. When the access cover is in place, the lock cover 13 cannot be removed by an unauthorized user. Moreover, the flanges 53 of the access cover are positioned atop the fasteners securing the base member 33 and the dead bolt lock assembly 20 to a given surface. Thus, the fasteners cannot be removed without removal of the access cover 31. This feature of the dead bolt cover provides further security against tampering of the dead bolt lock assembly 20.

It should be understood that other types of locks can be utilized to secure the cover 31 to the base member 33. The Medeco lock is merely exemplary. In addition, the main plate portion 41 can also be secured to the surface supporting the dead bolt lock assembly 20 by additional fasteners if so desired.

Figure 4:
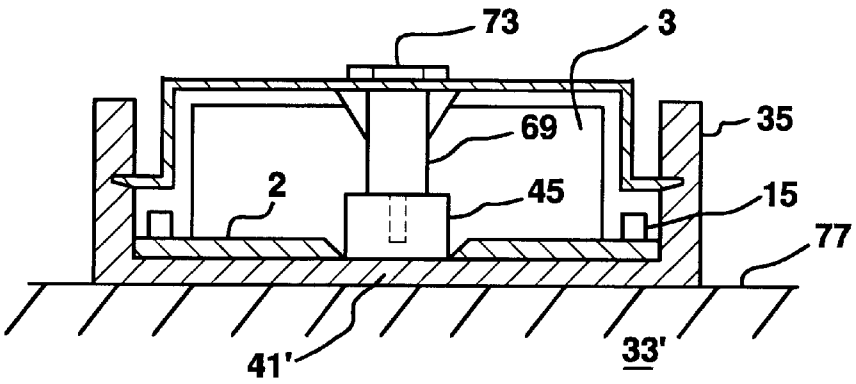
FIG. 4 is a cross-disectional view of an alternative embodiment to that shown in FIG. 3.

FIG. 4 shows an alternative embodiment to the dead bolt lock cover depicted in FIG. 3. In this embodiment, the sidewalls 35 are joined by a main plate portion 41' which extends the entire length of the sidewalls. The main plate portion 41' is designed to be positioned between the dead bolt lock base 1' and the surface 77 that it is attached to. In this embodiment, the fasteners 15' would first extend through the flange portion 2 of the dead bolt lock assembly 20 followed by passing through the main plate portion 41' and into the surface 77. In this embodiment, there is no need to have varying thicknesses of the base member 33 as shown in FIG. 3.

Figure 1:
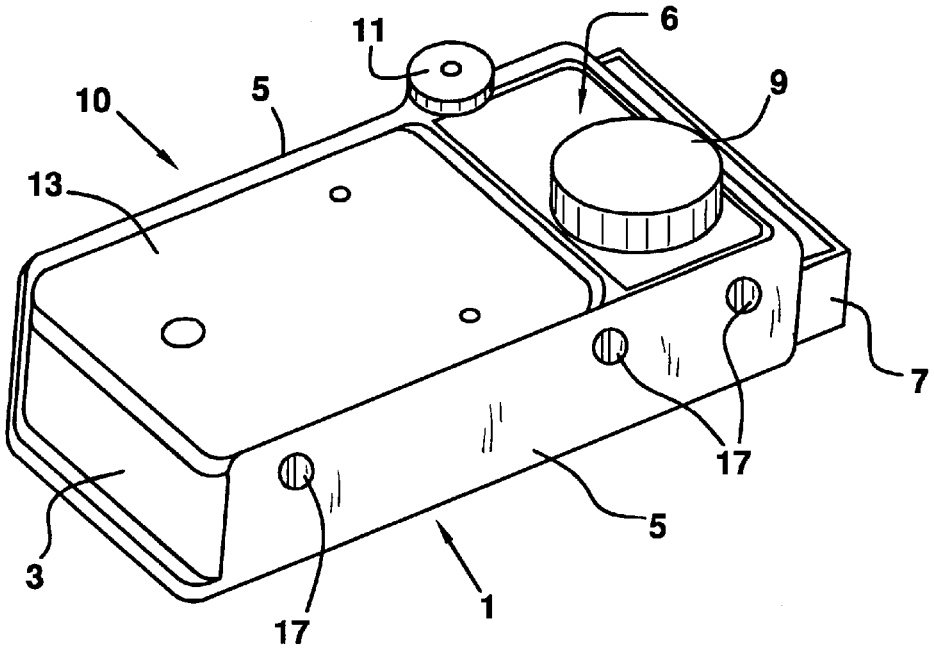
FIG. 1 PRIOR ART
FIG. 1 is a perspective view of one type of a prior art dead bolt lock.
Figure 5:
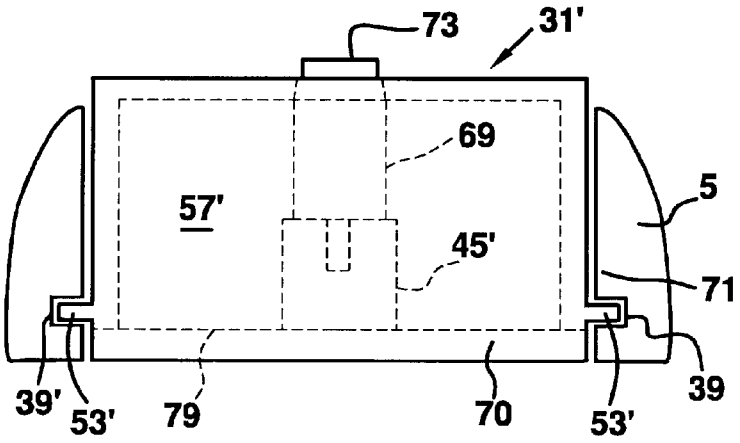
FIG. 5 is a view of another embodiment of the invention.
Figure 6:
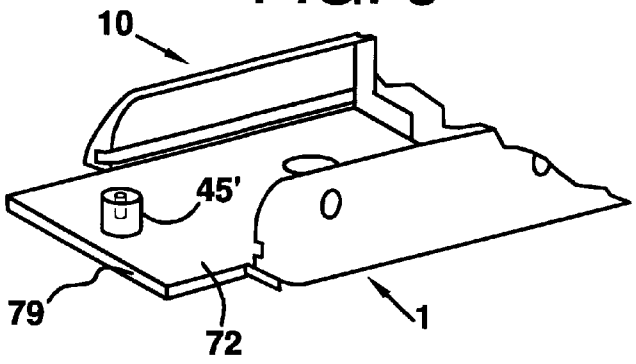
FIG. 6 is a perspective view of the modified dead bolt lock used the embodiment depicted in FIG. 5.

FIGS. 5 and 6 show an embodiment of the inventive dead bolt cover when used with the dead bolt lock assembly 10 shown in FIG. 1. In this embodiment, the dead bolt lock assembly 10 is illustrated with the base 1 having an extended base portion 72 sized so that the lock support 45' can be mounted thereto. In this embodiment, the back plate 57' abuts against the end face 79 of the main plate portion 72 so as to enclose the lock cylinder 69.

The sidewalls 5 of the dead bolt lock assembly 10 have slots 39' to receive the flanges 53' of the access cover 31'. The access cover 31' still retains the cut out 61 to permit access to the hold back feature knob 11 and the dead bolt operating knob 9 of the dead bolt lock access assembly 10. In this embodiment, there is no need for the cover to include a flange for fastener removal protection. However, the slots 39' could be sized or enlarged so that the cover flanges 53' can extend more outwardly to intersect the fastener openings 17 in the sidewalls 5 as shown in FIG. 1.

Although the main plate portion 70 is shown as an integral portion of the base 1 of the dead bolt lock assembly 10, a separate base positioned under the base 1 of the dead bolt lock assembly 10 could also be used, similar to that shown in FIG. 4. Other base embodiments could also be used as would be within the skill of the artisan.

Figure 7:
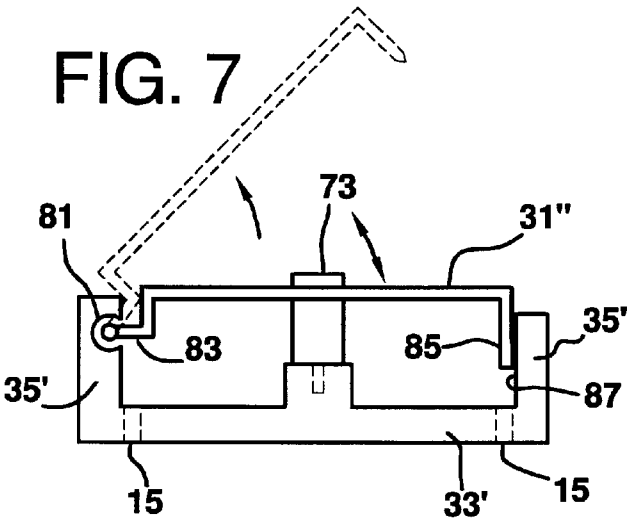
FIG. 7 is a still further embodiment of the embodiment depicted in FIGS. 3 and 4.

FIG. 7 shows an alternative embodiment to the access cover depicted in FIG. 3. In FIG. 7, a hinged arrangement is shown for access cover removal. The base member 33' is similar to that shown in FIG. 3 except that the sidewalls 35' do not have the opposing slots for cover insertion. Rather, one of the sidewalls 35' has a slot 81 sized to receive a hinge mechanism joined at the outer edge of the flange 83. The opposite end 85 of the cover 31' is flanged to abut against the inner face 87 of the other sidewall 35'. In this embodiment, the openings 15 are still protected from unauthorized tampering as is the lock casing cover (not shown).

With the lock 73 removed, the cover 31" can pivot upwardly as indicated by the arrow for access to the lock casing cover. To secure the dead bolt lock, the cover 31" can be pivoted back down and relocked for lock casing cover protection.

Although a sliding type access cover and a hinged type access cover are shown, other types of access cover attachments to the base member are within the realm of the invention as would be known by one of ordinary skill in the art. Other types of lock mechanisms could be used, e.g., mechanisms where the lock 59 would interface with one of the sidewalls, base member or the like. Likewise, the lock mechanism could be a different type, e.g. a cam lock, which could interface with a component other than the access cover or dead lock base/base member, or any other type lock. The lock can interface with the dead bolt itself or any other compound associated with the dead bolt lock assembly.

The access cover itself can be made of any known suitable material which would deter access the lock casing cover by piercing the access cover itself. Examples of suitable materials include alloy steels, nickel alloys, stainless steels or the like, either in cast or in wrought form. Other types of dead bolt lock assemblies as are known can be used with the inventive access cover.

As such, an invention has been disclosed in terms of preferred embodiments thereof which fulfill each and every one of the object of the present invention and provide a new and improved dead bolt lock access cover.

Of course, variations, alterations and modifications of the teachings of the present invention may be made by those of ordinary skill in the art without departing from the scope thereof. Accordingly, the invention is only to be limited by the terms of the appended claims.

What is claimed is:

1. A dead bolt lock assembly comprising:

a) a dead bolt lock having a lock casing for enclosing dead bolt lock components, said casing including a removable covering member allowing access to said components, and an operative member for dead bolt operation, and a base to receive the lock casing, the dead bolt lock assembly mountable to a surface; and b) a dead bolt lock cover comprising:

(i) a cover sized to enclose said lock casing while exposing the operative member for dead bolt operation; and (ii) a lock assembly to removably lock said cover over the lock casing to prevent unauthorized access to at least the lock casing.

2. The assembly of claim 1 wherein said lock assembly comprises a base member removably attachable to one of said base and said surface and a lock linked between said cover and said base member, opening of said lock permitting removal of said cover.

3. The assembly of claim 2 wherein said lock is a key lock.

4. The assembly of claim 1 wherein the base has fasteners for attaching the base to said surface and the cover is sized to enclose the fasteners when enclosing the lock casing.

5. The assembly of claim 2 wherein the base member has opposing sidewalls, each sidewall having a slot therein, the cover having opposing edges, each edge sized to slide in a respective said slot of the base member for lock casing enclosing.

6. The assembly of claim 1 wherein said cover has a cut out portion to expose the operative member.

7. The assembly of claim 2 wherein the cover is hinged at a portion thereof to the base member for said removable attachment.

8. The assembly of claim 2 wherein a portion of the base member is positioned between the surface and the base for removable attachment to said surface.

9. The assembly of claim 1 wherein the base of the dead bolt lock assembly includes sidewalls with said lock casing positioned therebetween, each sidewall having a slot, the cover having opposing edges sized to engage a respective said slot.

10. The assembly of claim 9 wherein said lock assembly includes a lock linked between the base and the cover, opening of said lock permitting removal of said cover.

11. The assembly of claim 9 wherein a portion of the base extends beyond said lock casing, the lock assembly linked between said portion of said base and said cover.

12. A dead bolt lock assembly comprising:

a) a dead bolt lock having a lock casing for enclosing dead bolt lock components, said casing including a removable covering member allowing access to said components, the dead bolt lock further having an operative member for dead bolt operation and a base to receive the lock casing, the dead bolt lock mountable to a surface; and b) a dead bolt lock cover comprising:

(i) a cover sized to enclose said lock casing while exposing the operative member for dead bolt operation; and (ii) means for removably locking said cover over the lock casing to prevent unauthorized access to at least said lock casing.

13. The assembly of claim 12 wherein the means for removably locking said cover includes means for enclosing fasteners of said base to prevent access thereto when said cover is enclosing said lock casing.

14. The assembly of claim 12 wherein said means for removably locking includes means for mounting said cover to said base.

15. The assembly of claim 14 wherein said means for mounting is a base member attachable to one of said base and said surface.

16. The assembly of claim 12 wherein the means for removably locking includes a lock for removably locking said cover.

17. The assembly of claim 15 wherein the means for removably locking includes a lock for removably locking said cover to said base member.

* * * * *